United States Patent [19]

Carroll et al.

[11] 4,215,666

[45] Aug. 5, 1980

[54] ARROW SPACING SCREW FOR ARCHERY BOW

[76] Inventors: Cornelius F. Carroll, 1310 Tuxedo Ave., Parma, Ohio 44134; Lloyd E. Abernathy, 10922 Killdare Ct.; Allen W. Miller, 10801 Ridgecrest Dr., both of St. Anns, Mo. 63074

[21] Appl. No.: 944,903

[22] Filed: Sep. 22, 1978

[51] Int. Cl.[3] ..... F41B 5/00

[52] U.S. Cl. ..... 124/41 A; 273/DIG. 8; 124/24 R

[58] Field of Search ..... 124/41 A, 24 R, 23 R, 124/88, 86, 22; 24/213 R; 85/66, 63

[56] References Cited

U.S. PATENT DOCUMENTS

| | | | |
|---|---|---|---|
| 1,646,431 | 10/1927 | Tomkinson | 85/66 |
| 2,006,813 | 7/1935 | Norwood | 24/213 R |
| 3,292,607 | 12/1966 | Hoyt | 124/24 R X |
| 3,482,563 | 12/1969 | Pint | 124/41 A X |

*Primary Examiner*—Richard C. Pinkham
*Assistant Examiner*—William R. Browne
*Attorney, Agent, or Firm*—Charles E. Markham

[57] ABSTRACT

A pliant hollow screw of thermo plastic material for threaded engagement in a bow handle section to adjustably space an arrow from the adjacent side of the bow. The screw has a cluster of integrally formed flexible pins projecting longitudinally from its closed, arrow engaging end and a harder metal expanding screw entered therein. The harder expanding screw being larger than the inside diameter of the hollow arrow spacing screw thereby to expand and lock it in an adjusted position. A modified form of the arrow spacing screw has a cluster of flexible filaments extending longitudinally from and attached to the arrow engaging end of the screw.

3 Claims, 8 Drawing Figures

ARROW SPACING SCREW FOR ARCHERY BOW

This invention relates to archery equipment and particularly to means for adjustably spacing the fore end of an arrow when in drawn position from the arrow side of the bow so that the fletched end of the arrow will clear the bow when passing.

BACKGROUND OF THE INVENTION

The problem clearing the fletched end of an arrow from the adjacent side of a bow as it passes is one of long standing and became more acute with the advent of plastic vane fletching, which in general, is somewhat stiffer than the well established conventional feather fletching. Also the problem is more pronounced in hunting arrows having relatively heavy broadhead points. This is because such arrows require longer and wider fletching to stabilize arrow flight than do the lighter pointed target arrows.

Means for adjustably spacing the fore end of an arrow from the adjacent side of a bow just sufficiently so that the fletched rear end will clear in passing the bow are known to have been employed. Also such means have included yielding or flexible portions engaging the arrow so as to cushion any inward lateral thrust thereof which may result from variations in arrow flexing or release of the bow string under shooting conditions.

One such presently commercially available means for adjustably spacing the fore end of an arrow from the adjacent side of a bow employs a hollow rigid metal screw for threaded engagement in a screw threaded bore extending through the handle section of a bow and includes a spring loaded plunger longitudinally slidable in the hollow screw and projecting from one end thereof for engaging an arrow. In this arrangement a lock or jam nut on the hollow metal screw is employed to lock the screw in an adjusted position in the bow handle section and when applied to a bow having a wood handle section it requires the inclusion of an internally threaded metal ferrule. This arrangement is however relatively complex and costly due to the close manufacturing tolerances required for satisfactory operation.

Another such means is disclosed in U.S. Pat. No. 3,292,607. In this arrangement a mounting plate 26 on which the arrow rest is mounted moves with the rest and an integral flexible arrow spacing element 20 as adjustment is made so that, while the arrow spacing element 20 is adjustable with respect to the adjacent side of the bow, it is not adjustable with respect to mounting plate 26. It would obviously be just as essential that the flexible arrow spacing element be adjustable with respect to the mounting plate 26 as to the adjacent side of the bow to preclude interference to the passing fletched end of an arrow. Also this arrangement is relatively complex and costly to produce.

OBJECTS OF THE INVENTION

An object of this invention is to provide a generally new and improved means for adjustably spacing the fore end of an arrow from the adjacent side of a bow which means is particularly simple, reliable, economical to construct and convenient to lock in or unlock from an adjusted position.

A further object is to provide a pliant screw for this purpose formed as a molding of suitable thermo plastic material which, when threadedly engaged in a screw threaded bore in a wooden bow handle and frequently adjusted, will not become loose due to wear of the screw threads in the wooden bow.

A further object is to provide a pliant screw for this purpose formed as a molding of suitable thermo plastic material which includes a flexible arrow engaging end portion formed as an integral portion of the screw.

A further object is to provide a screw for this purpose having a flexible arrow engaging end portion comprising a cluster of flexible small diameter pins or filaments extending longitudinally from the arrow engaging end of the screw.

A further object is to provide a hollow, pliant screw of thermo plastic material for threaded engagement in a screw threaded bore through a bow which includes a harder expansion screw of larger diameter than the inside diameter of the softer thermo plastic screw entered therein thereby to expand and lock the softer screw in an adjusted position in the bow.

Other objects and advantages will become apparent upon reading the following description in connection with the accompanying drawings.

THE DRAWINGS

DESCRIPTION

Figure 1:
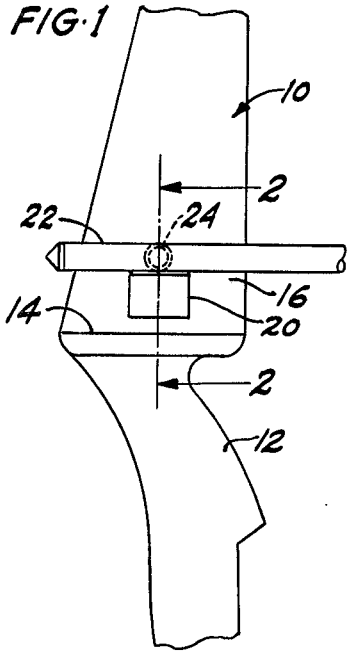
FIG. 1 is an arrow side elevational view of a fragmentary portion of a bow handle section showing an arrow rest, the fore end portion of an arrow and an arrow spacing screw (shown in dotted line) constructed in accordance with the present invention.
Figure 2:
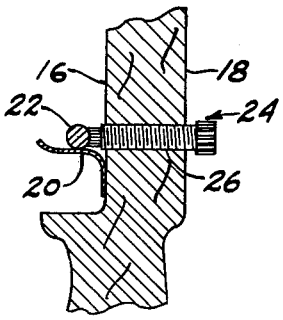
FIG. 2 is a cross sectional view taken along line 2—2 of FIG. 1.
Figure 6:
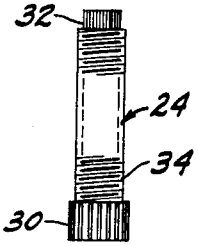
FIG. 6 is an approximate full size elevational view of the arrow spacing screw shown in FIG. 3.
Figure 5:
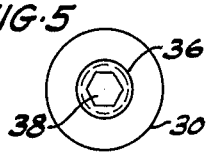
FIG. 5 is an opposite end view taken along lines 5—5 of FIG. 3.

Referring to the drawings in more detail, a conventional bow handle section 10 fragmentarily shown in FIGS. 1 and 2 has a hand grip portion 12, a ledge 14, an arrow side 16 and an opposite side 18. An arrow rest 20 attached to the arrow side 16 supports the fore end portion of an arrow 22. Extending through the bow from side to side and projecting from both sides thereof is an arrow spacing screw generally indicated at 24. Screw 24 is threadedly engaged in a screw threaded bore 26 extending through the bow handle section 10 from side to side. The screw 24 has a suitably knurled or serrated knob on the end projecting from the opposite side 18 and a cluster of small diameter, flexible pins or filaments projecting longitudinally from the other end thereof and engaging the arrow 22. As the screw 24 is rotated it variably spaces the fore end of arrow 22 from the side 16 of the bow handle section and the cluster of longitudinally extending flexible pins or filaments provide a cushioned contact between the screw 24 and arrow 22.

Figure 3:
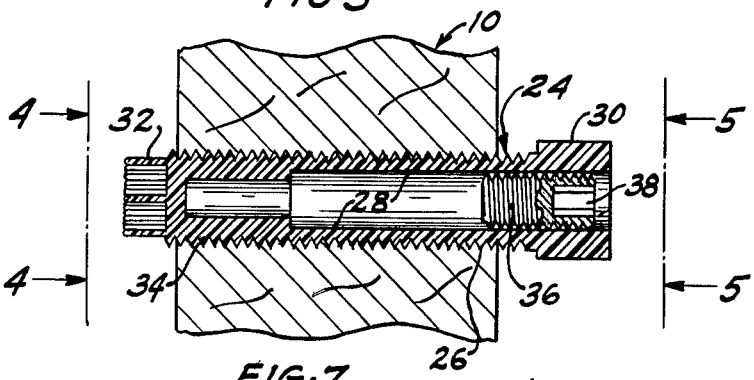
FIG. 3 is an enlarged longitudinal cross sectional view of the arrow spacing screw shown in FIGS. 1 and 2 shown threadedly engaged in a screw threaded bore extending through the handle section of a bow.
Figure 4:
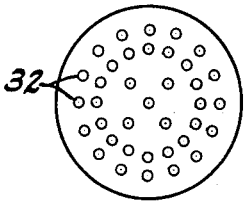
FIG. 4 is a still further enlarged arrow engaging end view of the arrow spacing screw looking along lines 4—4 of FIG. 3.

Referring to FIG. 3, the arrow spacing screw 24 is preferably formed as a molding of a suitable synthetic thermo plastic material such as polyurethane or the like and comprises a hollow cylindrical body closed at one end and with a bore 28 extending inward longitudinally therein from the other end the greater portion of the length of the body. An integrally formed serrated thumb knob 30 is formed at the open end and a cluster of integrally formed, small diameter, flexible pins 32 project longitudinally from the closed end. The exterior surface of the body between knob 30 and the closed end thereof is formed as a continuous screw thread 34.

Entered into the bore 28 of screw 24 is a headless metal screw 36 having a hexagonal socket 38 at one end for receiving a wrench. The major diameter of screw 36, which hereinafter is referred to as an expansion screw, is somewhat larger than the diameter of bore 28 so that as the harder metal screw 36 is advanced into the bore 28 of the softer thermo plastic screw 24, it expands the screw 24 and thereby locks it in an adjusted position in the screw threaded bore 26 in the bow handle section 10. As the harder metal screw 36 is advanced into the bore 28 of the thermo plastic screw 24, deformation of the bore 28 to form a partial screw thread occurs. But this deformation is to a substantial degree temporary due to the so-called "memory" characteristic of many suitable commercially available thermo plastic materials. Also the diametral expansion of the wall of the hollow screw 24 occasioned by the advance of the metal screw 36 to effect a locking of the screw in an adjusted position relaxes and recovers quickly from this deformation a sufficient amount as screw 36 is retracted to permit easy rotation of screw 24 to another adjusted position.

This arrangement provides a convenient and positive means for locking the screw 24 in an adjusted position against loosening under shooting conditions. Also it will be seen that by constructing the screw 24 of a relatively soft material such as a suitable thermo plastic material that the usual internally screw threaded metal ferrule usually employed with wood bows may be dispensed with and the screw threads cut directly in the wood handle section. This is because looseness due to thread wear will not occur with the softer thermo plastic screw 24.

It will be understood that while we prefer to make the bore 28 in screw 24 smooth for reason of economy and because the oversize expansion screw functions satisfactorily in a smooth bore to advance and retract upon rotation, we also contemplate forming an internal screw thread in bore 28 (not shown) having the same lead but a smaller pitch diameter than that of expanding screw 36.

The flexibility of the integrally formed clustered pins 32 obviously varies with their diameter and length. Also, the practicability of molding the pins 32 integral with the screw 24 is limited as their diameter decreases. We have found that by making the clustered pins 32 in the order of one thirty second of an inch in diameter and one eighth of an inch long, we can achieve a desired cushioning effect while still maintaining sufficient rigidity to maintain the arrow in an adjusted spaced relationship with the side of the bow. Also we have found it quite practicable to form pins 32 of these dimensions integral with screw 24 as a molding of a thermo plastic material.

DESCRIPTION OF MODIFIED FORM SHOWN IN FIGS. 7 AND 8

Figure 7:
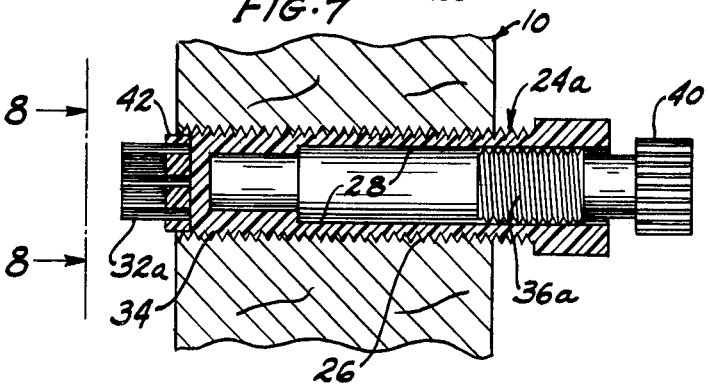
FIG. 7 is an enlarged longitudinal cross sectional view of a modified form of arrow spacing screw constructed in accordance with the invention.
Figure 8:
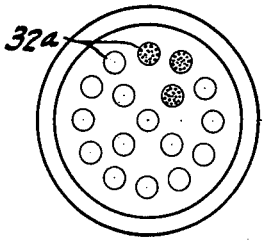
FIG. 8 is a still larger arrow engaging end view of the arrow spacing screw shown in FIG. 7, taken along lines 8—8 of FIG. 7.

Referring to FIGS. 7 and 8, the hollow arrow spacing screw generally indicated at **24*a* is similar to the screw 24 of FIG. 3 except that instead of a cluster of integrally formed flexible pins projecting from the closed end of the screw a cluster of short, flexible, longitudinally extending filaments 32*a* of nylon or like material is attached to the closed end of screw 24*a*. Also instead of a headless socketed screw 36, a rigid expanding screw 36*a* having a serrated thumb knob 40 at its exterior end is provided. The cluster of filaments 32*a* are suitably bonded in a disc 42 suitably attached, as by cementing, to the closed end of screw 24*a***.

Having described our invention:

1. An arrow spacing screw for threaded engagement in a screw threaded bore extending through an archery bow from its' arrow side to its' opposite side for adjustably spacing an arrow from the arrow side of the bow, said arrow spacing screw being formed as a molding of pliant thermoplastic material and comprising a cylindrical body having an external screw thread formed thereon for threaded engagement in the screw threaded bore in the bow and being of such length as to extend from both sides of the bow, a cluster of flexible filaments formed integral with said body and extending longitudinally from one end of said body for cushioning engagement with an arrow, and a turning knob formed integral with said body at its' other end.

2. An arrow spacing screw for threaded engagement in a screw threaded bore extending through an archery bow from its' arrow side to its' opposite side for adjustably spacing an arrow from the arrow side of the bow, said arrow spacing screw being formed as a molding of pliant thermoplastic material and comprising a hollow cylindrical body having an external screw thread formed thereon for threaded engagement in the screw threaded bore in the bow and being of such length as to extend from both sides of the bow, said hollow cylindrical body having a closed end and an open end, a cluster of flexible filaments extending longitudinally from said closed end for cushioning the engagement with an arrow, and a turning knob surrounding said open end, and a screw of larger diameter than the inside diameter of said hollow cylindrical body entered into said open end thereof to expand said body when said screw is advanced therein sufficiently to retain said spacing screw in a longitudinally adjusted position in the screw threaded bore in the bow, and to permit easy rotation of said arrow spacing screw to another longitudinally adjusted position as said screw is retracted from such advanced position.

3. The arrow spacing screw claimed in claim 2 in which the internal wall of said hollow cylindrical body is smooth.

* * * * *